US006097821A

United States Patent [19]

Yokoyama et al.

[11] Patent Number: 6,097,821

[45] Date of Patent: Aug. 1, 2000

[54] ELECTROSTATIC CAPACITANCE TYPE TRANSDUCER

[75] Inventors: Seiichi Yokoyama; Hiroji Ito; Fumio Kaise; Yukimitsu Sekimori, all of Tokyo, Japan

[73] Assignee: Nagano Keiki Co., Ltd., Tokyo, Japan

[21] Appl. No.: 08/969,957

[22] Filed: Nov. 25, 1997

[30] Foreign Application Priority Data

Nov. 27, 1996 [JP] Japan ..... 8-316237

[51] Int. Cl.[7] ..... H04R 25/00

[52] U.S. Cl. ..... 381/191; 381/396; 381/431; 381/184; 381/423

[58] Field of Search ..... 381/190, 191, 381/396, 398, 431, 429, 423, 374, 184, 386

[56] References Cited

U.S. PATENT DOCUMENTS 5,590,212 12/1996 Uryu ..... 381/191
5,600,610 2/1997 Hill et al. ..... 381/191
5,677,965 10/1997 Moret et al. ..... 381/191
5,748,758 5/1998 Menasco ..... 381/191
5,854,846 12/1998 Beavers ..... 381/191

*Primary Examiner*—Curtis A. Kuntz
*Assistant Examiner*—Dionne N. Harvey
*Attorney, Agent, or Firm*—Flynn, Thiel, Boutell & Tanis, P.C.

[57] ABSTRACT

In an electrostatic capacitance type transducer which has a substrate, a movable electrode confrontingly placed to the substrate in a movable manner through a space, a fixed electrode arranged on a detecting face confronting the movable electrode of the substrate, and a signal receiving portion which is conductive with the fixed electrode and derived from the detecting face of the substrate, the fixed electrode and the signal receiving portion are made of metals which are different with each other in their compositions. That is, the fixed electrode is made of metal which has a high corrosion resistance and is not likely to outbreak a hillock, and the signal receiving portion is made of metal which is easy for bonding. Alternatively, both the fixed electrode and the signal receiving portion are made of titanium. Through this, since the outbreak of the hillock can be prevented, the displacement of the movable electrode can be stably and precisely detected for a long time, and the shortening of the life of the fixed electrode caused by corrosion can be prevented. As to the signal receiving portion, an excellent bonding property can be ensured.

18 Claims, 2 Drawing Sheets

ELECTROSTATIC CAPACITANCE TYPE TRANSDUCER

BACKGROUND OF THE INVENTION

1. Field of the Invention

The present invention relates to an electrostatic capacitance type transducer used for a pressure sensor, an acceleration sensor, and so on.

2. Description of the Related Art

Conventionally, an electrostatic capacitance type transducer has been used for measuring instruments such as a pressure sensor or an acceleration sensor.

The electrostatic capacitance type transducer has a structure to have a fixed electrode and a movable electrode confronting each other in a manner that a substrate having the film-like fixed electrode is placed in front of the movable electrode through a space so that a displacement of the movable electrode to the substrate is detected as a change in electrostatic capacitance between the movable electrode and the fixed electrode.

For instance, in a electrostatic type pressure sensor, a diaphragm as a movable electrode is formed of a conductive silicon. When a fluid pressure is measured by the electrostatic capacitance type pressure sensor, the fluid is introduced on the surface opposite to the substrate surface of the diaphragm, and the pressure of the fluid is converted into an electric signal by detecting the displacement of the diaphragm resulting from the pressure of the fluid as the change in the electrostatic capacitance.

The fixed electrode of such electrostatic capacitance type transducer is derived from the detecting face through a through hole and the like which is formed on the substrate, and is electrically connected to a signal processing circuit by connecting lead wire to the derived portion.

Since an aluminum wire or a gold wire is usually used for the lead wire, materials for the fixed electrode are limited to those which are capable of bonding to these wires. Among them, aluminum is widely used because it is moderate in price, superior in adherence with glass used for the substrate, and easy to carry out a photo-lithographical processing for forming patterns.

There is a disadvantage that, however, when the fixed electrode is formed with an aluminum film, it is apt to produce a protrusion called a "hillock" on the surface of the fixed electrode during measurement under high temperature or during a heating process in the production, and the distance between the fixed electrode and the movable electrode is changed by the hillock, thus disturbing a precise detection of the displacement of the movable electrode.

Particularly, since the distance between the fixed electrode and the movable electrode is decreased as the transducer becomes smaller in size, the effect of the hillock can not be ignored and there arises a possibility of detection failure due to contact of the grown up hillock with the movable electrode.

Aluminum is apt to be more subject to corrosion in a severe environment, especially in a corrosive environment such as existence of vapor condensation, acidic and alkaline substances in the atmosphere and so forth. So when aluminum is used for the fixed electrode, there arises a disadvantage that the life of the transducer is relatively shorter than expected.

Moreover changes in shape of the fixed electrode surface due to corrosion, affects the space between the movable electrode and the fixed electrode, which causes deterioration in the detection accuracy.

It is an object of the present invention to provide an electrostatic capacitance type transducer which ensures an excellent bonding property, high detection accuracy and an improvement of the corrosion resistance.

SUMMARY OF THE INVENTION

The present invention is to achieve the above described purpose by forming the electrodes with plural different materials though they have been hitherto formed with a single material.

More specifically, an electrostatic capacitance type transducer of the present invention has a substrate, a movable electrode confronting the substrate in a movable manner to the substrate and having a space between the substrate, a fixed electrode provided on a detecting face of the substrate inof which the detecting face is confronting the movable electrode, and a signal receiving portion conducted to the fixed electrode and derived from the detecting face of the substrate, and has a characteristic that the fixed electrode and the signal receiving portion are made of metal having different compositions from each other.

Since the fixed electrode and the signal receiving portion are formed of metals having different compositions from each other in the present invention, it becomes possible to provide different properties required to the fixed electrode and the signal receiving portion, respectively.

Accordingly, when the fixed electrode is made of a metal which has high corrosion-resistance and is not likely to create the hillock, distance to the movable electrode can be maintained in a normal condition so that the contact between the fixed electrode and the movable electrode can be avoided. Therefore, the displacement of the movable electrode can be accurately and consistently detected for a long time, and a malfunction such as shortening of the whole transducer caused by corrosion of the fixed electrode, can be prevented. Since the signal receiving portion does not practically affect the properties of the transducer, that is, the properties such as the displacement of the movable electrode and the change in electrostatic capacitance based on the displacement, unless the function to take out the electric signal from the fixed electrode is damaged, a good bonding property can be ensured when the signal receiving portion is formed with a metal to which conductive wire can be easy bonded.

Thus, it is preferable to make the fixed electrode with a hard-to-deform metal, and the signal receiving portion with a easy-to-bond metal which is able to bond.

Here, the hard-to-deform metal means a metal which does not easily create the hillock, and can be adopted from metals such as a metal having a higher tensile strength at high temperatures than the expansion power resulting from water evaporation, a metal having a small difference in heat expansion rate between the substrate and the metal adopted, a metal whose periodicity of crystal is hampered by adding of impurities, and a metal having a high resistance to electromigration.

When the fixed electrode is formed with such a hard-to-deform metal, the creation of the hillock can be reliably prevented, so that the displacement of the movable electrode can be precisely detected.

As a cause of the outbreak of the hillock on the fixed electrode, it is conceivable that water on a boundary surface between the substrate and the fixed electrode is evaporated and expanded by heat and the fixed electrode is pushed up by the vapor. Therefore the use of the metal having a higher tensile strength at high temperatures than the strength generated in evaporation or expansion of water, for the hard-to-deform metal, eliminates the deformation of the fixed electrode under the pressure of the vapor and can depress the outbreak of the hillock on the fixed electrode.

When the fixed electrode is formed with a material having a higher coefficient of thermal expansion than that of the substrate, it is conceivable that some compressional stress is generated by heat on the fixed electrode, and the hillock is grown to ease the compressional stress. Therefore the use of metal having a small difference in the thermal expansion coefficient between the metal and the substrate for the hard-to-deform metal, reduces the thermal stress at high temperatures and the production of the hillock can be controlled.

Some hillocks are thought to be produced due to a slip of transition. Therefore the use of a metal which hampers the periodicity inside the crystal by means of alloying, adding impurities, doping and so forth, for the hard-to-deform metal, hampers the slip of transition (migration of atoms along the grain boundary), and the production of the hillock can be controlled.

Additionally, electro-migration is also thought to be one of the causes of the hillock. Therefore the use of metals whose resistance against the electro-migration is improved by alloying, adding of impurities, doping and so forth, for the hard-to-deform metal, restraints transition of metal atoms caused by electric current and electric field, and the production of the hillock can be prevented.

When the signal receiving portion is formed with an easy-to-bond metal which is able to bond, the signal receiving portion can be simply and securely bonded by electrically connecting the signal receiving portion to signal processing circuits and the like through wire.

The hard-to-deform metal, more specifically, is preferably any one of titanium, chromium, nickel, silicon, cobalt, palladium, tantalum, or gold, or an alloy in which any one of titanium, chromium, nickel, iron, tungsten, silicon, aluminum, cobalt, palladium, tantalum or gold is a main constituent. The easy-to-bond metal is preferably any one of aluminum, gold or an alloy in which aluminum or gold is a main constituent.

When either titanium or alloy of titanium as a main component is used for the hard-to-deform metal, the outbreak of the hillock on the fixed electrode can be securely prevented, because the tensile strength of titanium is stronger than the force generated in evaporation or expansion of water. Since titanium is superior in corrosion resistance, prevention of the corrosion of the fixed electrode can be ensured. Moreover, since titanium has a good workability, a desirable pattern can be easily formed in pattern forming process of the fixed electrode by photo-lithography.

When either aluminum or alloy of aluminum as a main component is used for the easy-to-bond metal, a superior signal receiving portion can be produced with a low cost because aluminum is low in price, superior in adherence with glass which is used for the substrate, easy to apply a photo-lithoprocess for pattern-forming.

By the way, the electrostatic capacitance type transducer according to the present invention is characterized by that it is provided with a substrate, a movable electrode confronting the substrate in a movable manner against the substrate and having a space between, a fixed electrode provided on a detecting face of the substrate in which the detecting face is confronting the movable electrode, and a signal receiving portion conducted to the fixed electrode and derived from the detecting face of the substrate, where the fixed electrode and the signal receiving portion are made of titanium.

In the present invention, since the fixed electrode is made of titanium which is the above described hard-to-deform metal, the outbreak of the hillock and corrosion can be prevented and an efficient workability can be obtained.

As a result of diligent study on titanium by the inventors, titanium is found to be able to bond at least to an aluminum wire. Accordingly, the signal receiving portion made of titanium can be securely connected to the signal processing circuit through the aluminum wire.

Further, since both the fixed electrode and the signal receiving portion are made of titanium, the same material is to be used in common.

In the above, a through hole can be provided on the substrate and the signal receiving portion can be provided on the opposite side face to the detecting face on the substrate, being conducted to the fixed electrode through the through hole.

The movable electrode can be a conductive diaphragm and the electrostatic capacitance type transducer can be a transducer which can detect the displacement of the diaphragm caused by pressure as a change in electrostatic capacitance.

In this case, it is preferable that the diaphragm is held between the substrate and a plane glass plate and the glass plate is provided with a pressure guiding port to apply pressure on the diaphragm.

In short, when the pressure to be measured is applied through the pressure guiding port, only the object for the pressure measurement can be introduced to the diaphragm, and the detection can be carried out with high accuracy.

DETAILED DESCRIPTION OF THE PREFERRED EMBODIMENT(S)

Figure 1:
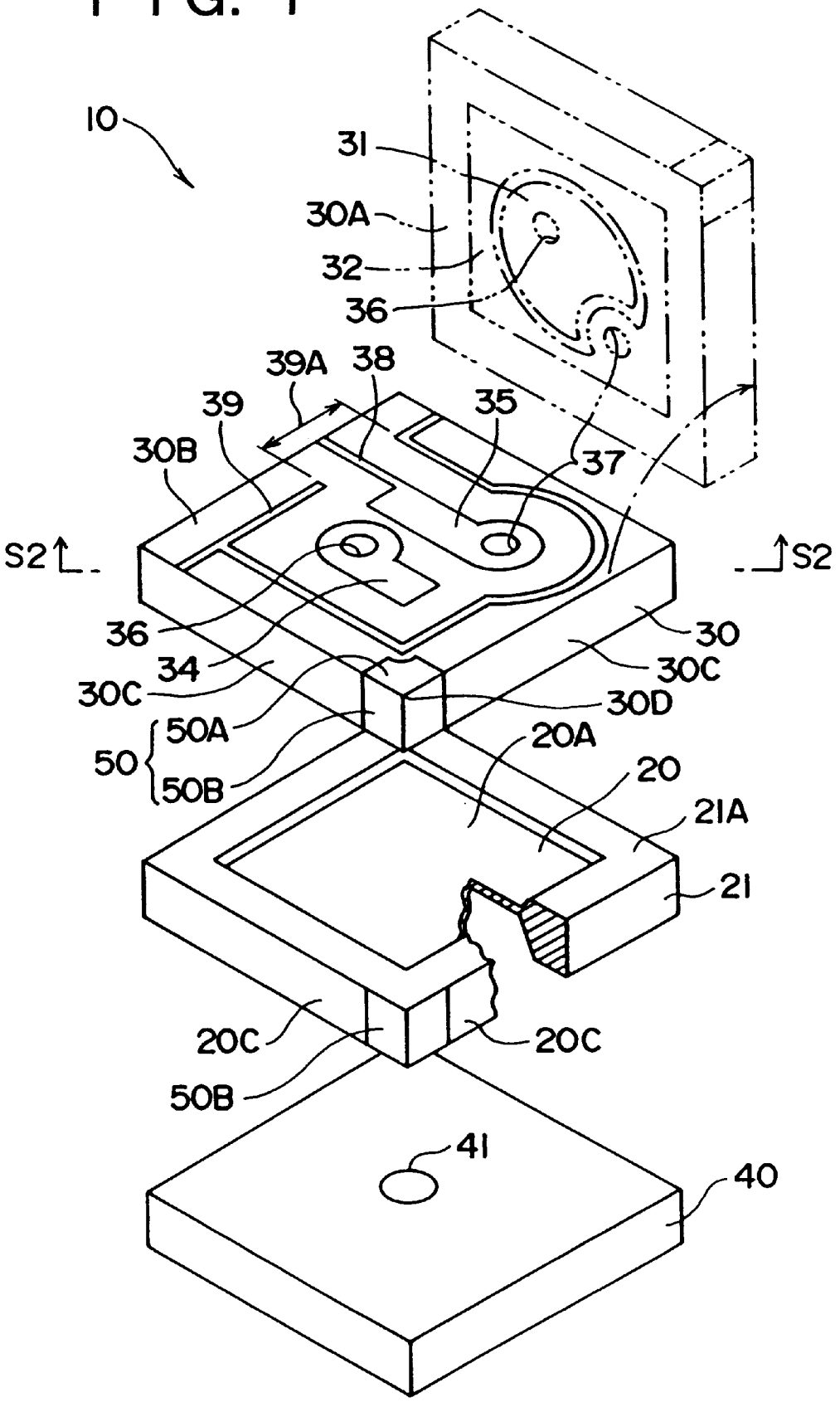
FIG. 1 is an exploded perspective view of an embodiment of the present invention.

FIG. 1 shows a pressure sensor 10 as an electrostatic capacitance type transducer. The pressure sensor 10 is the electrostatic capacitance type pressure sensor to detect pressure as a change in electrostatic capacitance and is composed of a diaphragm 20 which can perform elastic deformation required for a movable electrode, and a plane upper glass 30 and a plane bottom glass 40 (a glass plate) which are connected in an anode-contact to a thick portion 21 of the circumference of the diaphragm 20 and hold the diaphragm 20 between the upper glass 30 and the bottom glass 40.

Between the diaphragm 20 and the upper and bottom glasses 30, 40, a designated space is formed inside the thick portion 21. The diaphragm 20 can displace relative to the upper glass 30 or the substrate by means of elastic deformation in the space.

Figure 2:
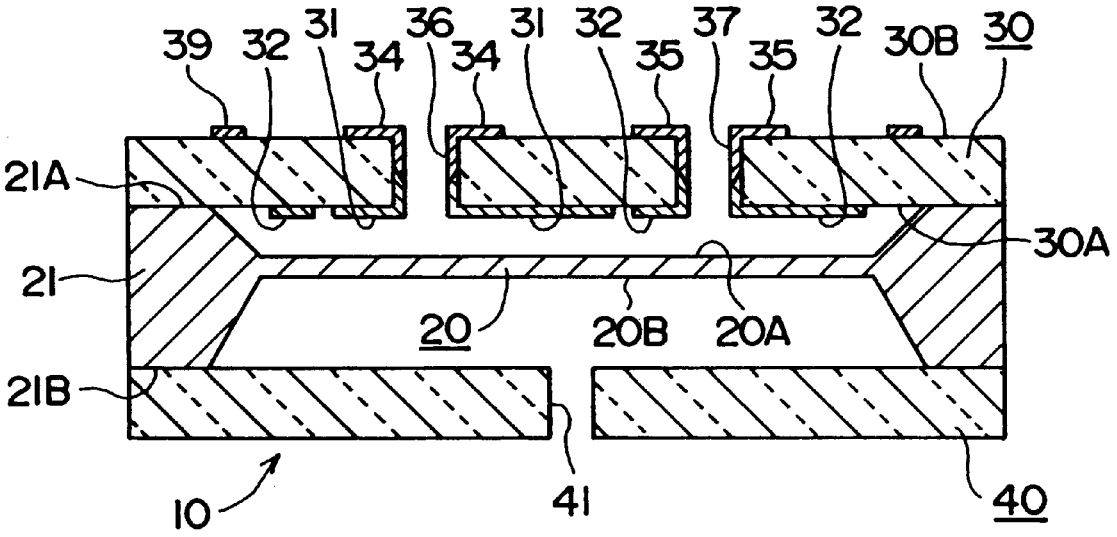
FIG. 2 is a sectional view taken along the S—S line in FIG. 1.

The diaphragm 20 is consisted of a conductive silicon, for instance, a single crystal silicon, and the diaphragm 20 itself serves as an electrode. In the diaphragm 20, a confronting surface 20A which confronts the upper glass 30 is dented a little lower than the upper surface of the thick portion 21, and a confronting surface 20B (see FIG. 2) which confronts the bottom glass 40 is higher than the bottom surface 21 B of the thick portion 21 (being dented), as shown in FIG. 2. The diaphragm 20 is formed in a manner that each different level portion is etched through a photo resist process and the like from, ,for instance, about 0.1 mm thick silicon.

Note that, though not limited, the difference in level from the confronting surface 20A to the upper surface 21A of the thick portion 21 is, for instance, from about 2 to 8 μm level, and the difference in level from the confronting surface 20B to the bottom surface 21B is, for instance, about 80 μm level.

The upper glass 30 is the substrate in the present invention, and the detecting surface 30A which confronts the diaphragm 20 is provided with a film-like central electrode 31 as the fixed electrode and a film-like peripheral electrode 32 as the fixed electrode surrounding the central electrode 31.

An upper surface, an exposed surface, 30B (an opposite side surface to the detecting surface 30A) of the upper glass 30 is provided with film like signal receiving portions, signal receiving traces, 34, 35 which extend from the detecting surface 30A. These signal receiving portions 34, 35 are respectively conducted to the central electrode 31 and the peripheral electrode 32 through the through holes 36, 37 provided on the upper glass 30. Between the signal receiving portions 34, 35, the signal receiving portion 35 which is conducted to the peripheral electrode 32 has a leading portion 38 which is led to the end portion of the upper glass 30.

The central electrode 31 and the peripheral electrode 32 of the detecting surface 30A and the signal receiving portions 34, 35 of the upper surface 30B are made of different metals with each other, more specifically, the central electrode 31 and the peripheral electrode 32 are made of a hard-to-deform metal, or titanium, and the signal receiving portions 34, 35 are made of an easy-to-bond metal, or aluminum, which is easy for bonding.

The central electrode 31 and the signal receiving portion 34, and the peripheral electrode 32 and the signal receiving portion 35 contact with each other to make them conductive at the through holes 36 and 37, respectively, as shown in FIG. 2, and the fixed electrodes 31, 32 and the signal receiving portions 34, 35 become a thin film at the contact point so that they gradually exchange their function with each other. That is, the fixed electrodes 31, 32 are formed in a manner that the thickness of the film becomes thinner from the detecting surface 30A side toward the upper face 30B side, while the signal receiving portions 34, 35 are formed in a manner that the thickness of the film becomes thinner from the upper face 30B side toward the detecting face 30A side, and these fixed electrodes 31, 32 and the signal receiving portions 34, 35 are filmed so that they are overlapped at the inside of the through holes 36 and 37, respectively.

Back to FIG. 1, an anode-contact electrode 39 used for anode-contact is provided on the upper face 30B of the upper glass 30 and the anode-contact electrode is shaped nearly in response to the brim of the diaphragm, surrounding each signal receiving portions 34 and 35, and the leading portion 38 is brought out through a discontinuous portion 39A.

A signal receiving portion 50 to receive signals taken out from a side face 20C of the diaphragm 20 is provided on the corner portion 30D of the upper glass 30. The receiving portion 50 is formed continuously with an upper face 50A and a side face SOB extending over a side face 20C of the diaphragm 20 and a side face 30C of the upper glass 30.

Note that the signal receiving portion 50, the leading portion 38, and the anode-contact electrode 39 are made of the same aluminum as the signal receiving portions 34 and 35.

The bottom glass 40 has a pressure guiding port 41 provided nearly on the central portion and the pressure is applied through the pressure guiding port 41.

Incidentally, the bottom glass 40 can be suitably omitted in consideration of how to use and what to use the pressure sensor.

In this pressure sensor 10, once pressure is introduced into the pressure guiding port 41, the diaphragm 20 is elastically deformed in a curved shape, the distances between the diaphragm 20 and the central electrode 31 on the upper glass 30 and between the diaphragm 20 and the peripheral electrode 32 on the upper glass 30 are changed, the electrostatic capacitance is changed according to the above described distance, and pressure measurement is carried out using the change in the electrostatic capacitance. Since the displacement of the diaphragm 20 is large around the central portion and small around the peripheral portion, a difference in electrostatic capacitance comes out between the diaphragm 20 and the central electrode 31, the peripheral electrode 32 of the upper glass 30. By measuring the difference, and by conducting conventional signal processing like rectifying errors based on changes in temperature, removing noise, the pressure can be more accurately detected.

Note that, the pressure sensor 10 is so called a gauge pressure sensor (the difference in pressure when the atmospheric pressure is taken as zero), a space portion between the diaphragm 20 and the upper glass 30 is left open to the atmosphere through each through holes 36, 37 of the central electrode 31 and the peripheral electrode 32.

A production process of the pressure sensor 10 will be explained below.

For a start, the diaphragm 20 is formed by etching and the like and the pressure guiding port 41 is provided on the bottom glass 40.

The through holes 36, 37 are formed on the upper glass 30 which serves as the substrate, a thin titanium film is covered on the detecting face 30A by evaporation or sputtering, and a thin aluminum film is formed on the upper face 30B of the opposite side in a similar manner. Through these film forming processes, on the inside of the through holes 36 and 37, the titanium thin film is formed gradually thinner toward the upper face 30B, and the aluminum thin film is formed gradually thinner toward the detecting face 30A. Next, the titanium film and the aluminum film are got in contact inside the through holes 36, 37 and conducted. The order of the film forming process of these titanium and aluminum films is not limited.

Next, patterns of the central electrode 31 and the peripheral electrode 32 are formed on the titanium film on the detecting face 30A by photolithography and patterns of the signal receiving portions 34, 35, the lead portion 38, the anode-contact electrode 39 and the upper face 50A of the signal receiving portion 50 are formed on the aluminum film of the upper face 30B.

After the bottom glass 40, the diaphragm 20 and the upper glass 30 are stacked in order, a voltage of about 400V is applied between them under a high temperature of about 400° C. so that the leading portion 38 and the diaphragm 20 side is the plus pole, and the anode-contact electrode 39 and the bottom glass 40 side is the minus pole and the bottom glass 40, the diaphragm 20 and the upper glass 30 is connected in anode-contact.

After that, the side face SOB which is provided in advance on the upper face 30B and is extending over the upper face 50A is filmed with aluminum by evaporating or sputtering aluminum on the side face 20C of the diaphragm 20 and on the side face 30C (the comer portion 30D) of the upper glass 30 and thus the receiving portion 50 is formed.

Next, the signal receiving portion 34, 35 and the receiving portion 50 are bonded with aluminum wire (not shown in figures) and electrically connected to the signal processing circuit (not shown).

The pressure sensor 10 is not limited to what is produced in a single form, but it can be produced by anodically joining a silicon wafer which is a diaphragm wafer integrally formed with a plurality of the diaphragms 20, an upper glass wafer which is integrally formed with a plurality of the upper glass 30, and a bottom glass wafer which is integrally formed with a plurality of the bottom glass 40 together into a laminated wafer, and cutting the plural pressure sensors 10 (a single sensor tip) formed in the laminated wafer along the designated cutting positions into each pieces.

According to the present embodiment, the following effects can be expected.

Since the central electrode 3 1, the peripheral electrode 32 and the signal receiving portions 34, 35 are made of different metals from each other, desired different properties can be provided to the fixed electrode 31, 32 and the signal receiving portion 34, 35, respectively.

Since the central electrode 31 and the peripheral electrode 32 are formed with a hard-to-deform metal which is not likely to cause the hillock, the outbreak of hillock on the central electrode 31 and the peripheral electrode 32 can be securely prevented and the distance between the central and peripheral electrode 31, 32 and the diaphragm 20 can be maintained in normal conditions, the displacement of the diaphragm 20 can be precisely detected stably for a long time. Since the outbreak of hillocks is controlled, a trouble to make measurement impossible, which is caused by contacting the central electrode 31 and the peripheral electrode 32 with the diaphragm 20, can be certainly prevented.

Further, the central electrode 31 and the peripheral electrode 32 are made of titanium among metals of hard-to-deform property, which has a higher tensile strength than vapor pressure or expansion power of water, the outbreak of the hillock can be surely controlled because the central electrode 31 and the peripheral electrodes 32 are not deformed by the vapor pressure of water existing between them and the upper glass 30, even anode-contact is carried out in a high temperature of 400° C., or pressure measurement is carried out under high temperatures.

Besides, since titanium is superior in corrosion resistance in a severe environment, the corrosion of the central electrode 31 and the peripheral electrode 32 can be surely prevented so that the distance between the central and peripheral electrodes 31, 32 and the diaphragm 20 is not fluctuated by the corrosion. Thus the high accurate output property can be maintained for a long period, which lengthen the life of the whole pressure sensor 10.

Titanium also has a good workability, so desired patterns can be easily formed when the central electrode 31 and the peripheral electrode 32 are formed in pattern forming by photo-lithography.

Since the signal receiving portions 34 and 35 are formed with an easy-to-bond metal which is easy for bonding, excellent bonding property can be secured, and the wire for connecting to the signal processing circuit can be securely and easily bonded.

Further, since the signal receiving portions 34 and 35 are formed with aluminum which is low in price among the easy-to-bond metals, the cost for parts can be reduced. And as aluminum is superior in adherence with the upper glass 30 and the bottom glass 40, fairly good signal receiving portions 34, 35 can be easily formed. Since aluminum is so easy to be processed by photo-lithoprocess for pattern forming, that the signal receiving portions 34 and 35 are easily formed.

Since aluminum which forms the signal receiving portions 34 and 35, is the same material with the wire, still more better bonding property can be ensured.

Moreover, the signal receiving portions 34, 35 of the upper face 30B on the upper glass 30, the leading portion 38, the anode-contact electrode 39 and the upper face 50A of the receiving portion 50 are commonly formed with aluminum, so that the pattern forming is simultaneously carried out, thus making the production easy.

Further, since the leading portion 38 is electrically connected with the peripheral electrode 32 surrounding the central electrode 31, and the same voltage with the diaphragm is applied to the leading portion 38 during the anode-contact, the peripheral electrode 32, the central electrode 31 surrounded by the peripheral electrode 32 and the diaphragm 20 can be at the same potential, and the diaphragm can be prevented to draw near toward the upper glass 30 during the anode-contact.

Further again, since the receiving portion 50 for the diaphragm 20, pulled out from the diaphragm 20 through the side face 20C and 30C is provided on the comer portion 30D of the upper glass 30 which is an insulator, there is no need for forming a receiving portion by cutting the comer portion 30D off from the upper glass 30. Therefore, even when the pressure sensor 10 is small in size, the receiving portion 50 of the diaphragm 20 can be simply formed, and miniaturization of the pressure sensor is promoted.

The present invention is not limited to the above described embodiments, but it includes other constructions which can achieve the purposes of the present invention, and the following variations are included within the scope of present invention.

In the above described embodiment, titanium is used as a hard-to deform metal used to constituting the central electrode 31 and the peripheral electrode 32, but an alloy in which a major constituent is titanium, can be used, for instance. Other hard-to-deform metals, for instance, any one of chromium, nickel, silicon, cobalt, palladium, tantalum or gold can be used to form the electrodes. Also, an alloy whose main component is any one of chromium, nickel, iron, tungsten, silicon, aluminum, cobalt, palladium, tantalum, or gold can be used.

Further, in the above described embodiment, aluminum is used as a easy-to-bond metal used to constitute the signal receiving portion 34 and 35, but an alloy in which a major constituent is aluminum can be used. Alternatively other easy-to-bond metal can be used to form the signal receiving portions, for instance, gold or an alloy of which a major constituent is gold can be used.

In consideration of the relations between the hard-to-deform metal and the easy-to-bond metal for selection of the aforementioned materials, the ionization tendency of these materials may be added to the consideration. For instance, the use of nobler metal as a hard-to-deform metal for the central electrode 31 and the peripheral electrode 32, than any metal as an easy-to-bond metal for the signal receiving portions 34, 35, inside electrodes 31 and 32 can be relatively more protected.

In the aforementioned embodiment, the central electrode 31, the peripheral electrode 32, and the signal receiving portion 34, 35 are formed of mutually different materials, more specifically, titanium and aluminum, but both of these electrodes and signal receiving portions can be formed of titanium. In this case, since titanium can be bonded to aluminum wire and the signal receiving portion can be securely connected to the signal processing circuit, not only that similar function and effect as those in the aforementioned embodiment can be obtained, but also a common material for the fixed electrode and the signal receiving portion can be used.

Further, the signal receiving portions 34, 35 in the aforementioned embodiment are derived from the through holes 36, 37 of the upper glass 30 to the upper face 30B, but the signal receiving portions 34, 35 can be derived, for instance, from some midpoint between the upper glass 30 and the diaphragm 20. Whether the signal receiving portions 34, 35 should be derived to the upper face 30B can be decided as needed in accordance with how to use and what to use the pressure sensor.

In the aforementioned embodiment, the central electrode 31 and the peripheral electrode 32 are arranged only on the upper glass 30, but the present invention can be also applied to the pressure sensor which has similar electrodes on the bottom glass 40.

The number of the electrodes which are arranged on the substrate such as glass is not limited to two pieces as is in the case of the central electrode 31 and the peripheral electrode 32 in the aforementioned embodiment, but more than two pieces of each electrode corresponding to the central electrode and the peripheral electrode can be provided, respectively.

Further, in the aforementioned embodiment, the leading portion 38, the electrode 39 for anode-contact, and the upper face 50A of the receiving portion 50, which are all on the upper face 30B are made of the same aluminum as used for the signal receiving portions 34 and 35, but other conductive metals may be used.

In the aforementioned embodiment, the diaphragm 20 itself serves as an electrode, but when the diaphragm is of an insulator, a thin conductive layer can be provided on the diaphragm to be an electrode by using semiconductor processing technology or the like so that it can be a movable electrode.

Further, in the aforementioned embodiment, the thick portion 21 is arranged around the diaphragm 20 to form an integrated body, it is also acceptable that the thick portion is attached to the substrate to form an integrated body by providing an concave portion on the substrate made of glass and the like so that the diaphragm can have a uniform thickness. A configuration in which another thick member is inserted between a diaphragm and the substrate can be also accepted.

The electrostatic capacitance type transducer is not limited to the pressure sensor 10 for pressure measurement in the aforementioned embodiment, it may be used for other measuring instruments to measure other quantity of state. For instance, it may be an acceleration sensor in which a weight is provided to the movable electrode. In other words, the electrostatic capacitance type transducer which has a substrate, a movable electrode confrontingly placed to the substrate in a movable manner through a space, a fixed electrode arranged on a detecting face which is confronting the movable electrode on the substrate, and a signal receiving portion which is electrically conducted to the fixed electrode and derived from the detecting face on the substrate, is within the scope of the present invention and how to use and what to use are all at will.

What is claimed is:

1. An electrostatic capacitor type transducer comprising:

a substrate having a detecting surface and an exposed surface opposite the detecting surface;

a fixed electrode bonded to the detecting surface of said substrate, said fixed electrode being formed from a first metal a signal receiving trace bonded to the exposed surface of said substrate and that does not extend over the detecting surface of said substrate, said signal receiving trace being electrically connected to said fixed electrode and being formed from a second metal that is different from the first metal; and a movable electrode attached to said substrate over the detecting surface and capable of movement relative to said fixed electrode.

2. The electrostatic capacitance type transducer according to claim 1, wherein said fixed electrode is one selected from the group consisting of titanium, chromium, nickel, silicon, cobalt, palladium, tantalum, and gold, and an alloy thereof.

3. The electrostatic capacitance type transducer according to claim 2, wherein said substrate is provided with a through hole; and said signal receiving trace extends into and is electrically connected to said fixed electrode through said through hole.

4. The electrostatic capacitance type transducer according to claim 3, wherein said movable electrode is a diaphragm that is electrically conductive and that is displaced by pressure and the displacement is detectable as a change in electrostatic capacitance.

5. The electrostatic capacitance type transducer according to claim 2, wherein said movable electrode is a diaphragm that is electrically conductive and that is displaced by pressure and the displacement is detectable as a change in electrostatic capacitance.

6. The electrostatic capacitance type transducer according to claim 2, wherein said signal receiving trace is formed from one selected from the group consisting of aluminum, gold, and an alloy thereof.

7. The electrostatic capacitance type transducer according to claim 1, wherein said fixed electrode is formed from titanium or an alloy of titanium; and said signal receiving trace is formed from aluminum or an alloy of aluminum.

8. The electrostatic capacitance type transducer according to claim 7, wherein said substrate is provided with a through hole;

said signal receiving trace extends into and is electrically connected to said fixed electrode through said through hole;

said movable electrode is a conductive diaphragm which is held between said substrate and a plane glass plate;

said glass plate has a pressure inlet through which pressure is applied to said diaphragm; and displacement of said diaphragm caused by pressure is detected as a change in electrostatic capacitance.

9. The electrostatic capacitance type transducer according to claim 1, wherein said substrate is provided with a through hole; and said signal receiving trace extends into and is electrically connected to said fixed electrode through said through hole.

10. The electrostatic capacitance type transducer according to claim 1, wherein said movable electrode is a conductive diaphragm and displacement of said diaphragm caused by pressure is detectable as a change in electrostatic capacitance.

11. The electrostatic capacitance type transducer according to claim 10, wherein said diaphragm is held between said substrate and a plane glass plate; and said glass plate has a pressure inlet through which pressure is applied to said diaphragm.

12. The electrostatic capacitance type transducer according to claim 1, wherein said signal receiving trace is formed from one selected from the group consisting of aluminum, gold, and an alloy thereof.

13. An electrostatic capacitance type transducer comprising:

a substrate having a detecting surface and an exposed surface opposite the detecting surface;

a movable electrode secured to said substrate adjacent the detecting surface, said movable electrode capable of movement relative to the detecting surface;

a fixed electrode disposed on the detecting surface of said substrate, said fixed electrode being formed from titanium or an alloy of titanium; and a signal receiving trace bonded to the exposed surface of said substrate and that does not extend to the detecting surface of said substrate, said signal receiving trace being electrically connected to said fixed electrode and being formed from metal other than titanium or an alloy that does not include titanium.

14. The electrostatic capacitance type transducer according to claim 13, wherein said substrate is provided with a through hole; and said signal receiving trace extends into and is electrically connected to said fixed electrode through said through hole.

15. The electrostatic capacitance type transducer according to claim 14, wherein said movable electrode is a conductive diaphragm which is held between said substrate and a plane glass plate;

said glass plate has a pressure inlet through which pressure is applied to said diaphragm; and displacement of said diaphragm caused by pressure is detectable as a change in electrostatic capacitance.

16. The electrostatic capacitance type transducer according to claim 13, wherein said movable electrode is a conductive diaphragm; and displacement of said diaphragm caused by pressure is detectable as a change in electrostatic capacitance.

17. The electrostatic capacitance type transducer according to claim 16, wherein said diaphragm is held between said substrate and a plane glass plate; and said glass plate has a pressure inlet through which pressure is applied to said diaphragm.

18. The electrostatic capacitance type transducer of claim 13, wherein said signal receiving trace is made of one selected from the group of aluminum, gold, and an alloy thereof.

* * * * *